US006905043B2

(12) United States Patent
Zilberman

(10) Patent No.: US 6,905,043 B2
(45) Date of Patent: Jun. 14, 2005

(54) RECEPTACLE WITH COMPARTMENTED PERIPHERAL WALL FOR DISPLAY OF PERSONALIZED GRAPHICS/TEXT

(76) Inventor: Guy Zilberman, 185 E. Palisade Ave., # D2B, Englewood, NJ (US) 07631

( * ) Notice: Subject to any disclaimer, the term of this patent is extended or adjusted under 35 U.S.C. 154(b) by 69 days.

(21) Appl. No.: 10/423,208

(22) Filed: Apr. 25, 2003

(65) Prior Publication Data

US 2003/0196924 A1 Oct. 23, 2003

Related U.S. Application Data

(63) Continuation-in-part of application No. 10/205,445, filed on Jul. 26, 2002.
(60) Provisional application No. 60/314,576, filed on Aug. 24, 2001.

(51) Int. Cl.[7] ..... B65D 1/40
(52) U.S. Cl. ..... 220/665; 220/662; 40/306
(58) Field of Search ..... 220/665, 662, 220/62.14, 62.18, 62.2, 23.91, 23.9, 23.87; 40/661, 720, 766, 738, 306, 324; 215/321, 43

(56) References Cited

U.S. PATENT DOCUMENTS

| | | | | | |
|---|---|---|---|---|---|
| 948,506 | A | * | 2/1910 | Horton | 40/514 |
| D130,014 | S | * | 10/1941 | Blatz | D27/126 |
| 2,834,130 | A | * | 5/1958 | Nelson | 40/312 |
| 2,844,893 | A | * | 7/1958 | Keller | 40/306 |
| 3,716,936 | A | * | 2/1973 | Miller | 40/720 |
| 4,001,959 | A | * | 1/1977 | Grendahl | 40/720 |
| 4,047,633 | A | | 9/1977 | Trombly | |
| 4,576,279 | A | * | 3/1986 | Ferderber | 206/225 |
| 5,275,277 | A | * | 1/1994 | Gallegos | 206/217 |
| 5,553,733 | A | | 9/1996 | Rosenthal | |
| 5,553,735 | A | | 9/1996 | Kimura | |
| 5,562,229 | A | | 10/1996 | Callahan | |
| 5,794,808 | A | * | 8/1998 | Sauget | 220/23.91 |
| 5,894,948 | A | | 4/1999 | Yeh | |
| 2002/0124451 | A1 | * | 9/2002 | Ong | 40/720 |

* cited by examiner

*Primary Examiner*—Joseph C. Merek
(74) *Attorney, Agent, or Firm*—Galbreath Law Offices P.C.; John A. Galbreath

(57) ABSTRACT

A receptacle with compartmented peripheral walls for displaying personalized and changeable graphics is disclosed. The receptacle has an inner cylinder and a transparent outer cylinder which are spaced apart by vertical spacers which divide the cavity between the cylinders into compartments, each of which houses a removable sheet of graphic material. In a preferred embodiment, each compartment is sized to hold a standard, stock sized paper, such as 8½"×11", so the graphics may be quickly and easily changed. Graphic sheet access means are also provided, whereby a user can conveniently change the graphic sheets without having to use a tool or turn the receptacle upside down.

8 Claims, 6 Drawing Sheets

RECEPTACLE WITH COMPARTMENTED PERIPHERAL WALL FOR DISPLAY OF PERSONALIZED GRAPHICS/TEXT

CROSS-REFERENCES TO RELATED APPLICATIONS

This application is a continuation-in-part of U.S. patent application Ser. No. 10/205,445, filed on Jul. 26, 2002, which itself claims priority to Provisional U.S. Patent Application No. 60/314,576, filed on Aug. 24, 2001.

BACKGROUND OF THE INVENTION

1. Field of the Invention

The present invention relates to receptacles, especially those typically used as wastebaskets in a domestic or office environment. More particularly, the invention comprises a receptacle having a transparent peripheral wall which is compartmented to receive a plurality of sheets of standard paper sizes, which may bear personalized graphics or text. Graphic sheet access means are also provided, whereby a user can conveniently change the graphic sheets without having to use a tool or turn the receptacle upside down.

2. Description of the Prior Art

People have always been interested in personalizing their surroundings to display their individuality. Over the years a number of different items, many of them various types of receptacles which may be personalized by the inclusion of personal graphic or textual matter, have been developed.

U.S. Pat. No. 5,894,948, issued to Frank Yeh on Apr. 20, 1999, presents a Novelty Mug Assembly having an inner mug and a transparent outer mug. Either a flat sheet formed into a cylinder or a preformed cylinder may be fitted between the inner mug and outer mug, the cylinder either having a graphic or textual design already thereon or being customizable by the user. Once the cylinder is placed within the outer mug, the inner mug is removably inserted, with a seal device placed therebetween. The cylinder may be replaced at the users discretion. By contrast, the periphery of the present invention is compartmentalized to receive a plurality of decorative sheets.

In U.S. Pat. No. 5,562,229, issued to Edward Callahan on Oct. 8, 1996, a DECORATIVE RECEPTACLE WITH REMOVABLE COVER is disclosed. An inner receptacle body has flanges at its upper and lower end which releasably hold an outer, tubular sidewall member in place. A base member is held in place by a plurality of pins which engage corresponding holes in the bottom of the tubular sidewall member. The tubular sidewall member may thereby be removed for cleaning or replacement with another sidewall member having the same or a different graphic design thereon. While Callahan provides a changeable, decorative cover for a receptacle, no provision is made for separately housing sheets of decorative material, as does the present invention.

Fumiyo Kimura discloses a VESSEL WITH DISPLAY FUNCTION in his U.S. Pat. No. 5,553,735, issued on Sep. 10, 1996. Kimura presents two distinct embodiments of his vessel. In a first embodiment an inner and an outer shell with a gap therebetween is formed as a single unit, closed at the top and sealed with a base unit. In several different versions of the second embodiment, an inner shell is inserted into an outer shell, the two elements being removably joined around the periphery of the upper edges. A cavity between the inner and outer shells may receive interchangeable graphic or textual displays. While Kimura provides for changing displays within the vessel, the separate and distinct chambers of the present invention are absent.

U.S. Pat. No. 5,553,733, issued to Linda M. Rosenthal on Sep. 10, 1996, sets forth an ARTICLE COVER. A rigid base element has a pliable peripheral wall attached around its perimeter, the wall being extendable to cover the exterior of an article placed therewithin. The free end of the peripheral wall is adjustable by an elastic band to fit over various sizes of items.

Edgar F. Trombly discloses an ICE CONTAINER in his U.S. Pat. No. 4,047,633, issued on Sep. 13, 1977. An inner container and an outer container are spaced apart one from the other and bonded together so as to form a dead air space therebetween. Decorative material may be placed between the inner container and a transparent outer container, but once the unit is sealed, the material can not be changed, as in the present invention.

None of the above inventions and patents, taken either singly or in combination, is seen to describe the instant invention as claimed.

SUMMARY OF THE INVENTION

The present invention satisfies the desire by many individuals to personalize a receptacle by providing the ability to changeably display graphic or textual matter of interest to themselves or to others. An inner cylinder, closed at the bottom and open at the top is fitted within a substantially transparent outer cylinder, also closed at the bottom and open at the top. A plurality of vertical spacers ensure a uniform gap between the inner and outer cylinders, as well as dividing the periphery into uniformly dimensioned chambers for receiving sheets of paper, or other thin material, bearing graphic or textual matter. The gap between the inner and outer cylinders is sealed by a removable gasket placed between the open ends thereof.

Several different embodiments also disclose graphic sheet access means, by which a user can conveniently change the graphic sheets without having to use a tool or turn the receptacle upside down. This additional feature is particularly important for young and old users, whose manual dexterity may not be fully developed or may be impaired, and whose physical strength may be limited.

Accordingly, it is a principal object of the invention provide a receptacle which may be easily decorated with graphic or textual matter.

It is another object of the invention to provide a wastebasket on which the graphic or textual matter may be easily changed, at the user's discretion.

It is a further object of the invention to provide a wastebasket offering protection from liquids and dirt to the graphic or textual matter displayed thereon.

Still another object of the invention is to provide a waste-basket which is light weight.

An additional object of the invention is to provide a waste-basket which can withstand a reasonable degree of abuse.

It is again an object of the invention to provide a wastebasket which is relatively inexpensive to produce, and therefore to purchase.

It is a further object of the invention to provide graphic sheet access means by which the user can conveniently change graphic sheets without having to use a tool or turn the receptacle upside down.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views and wherein.

DETAILED DESCRIPTION OF THE PREFERRED EMBODIMENTS

Figure 2:
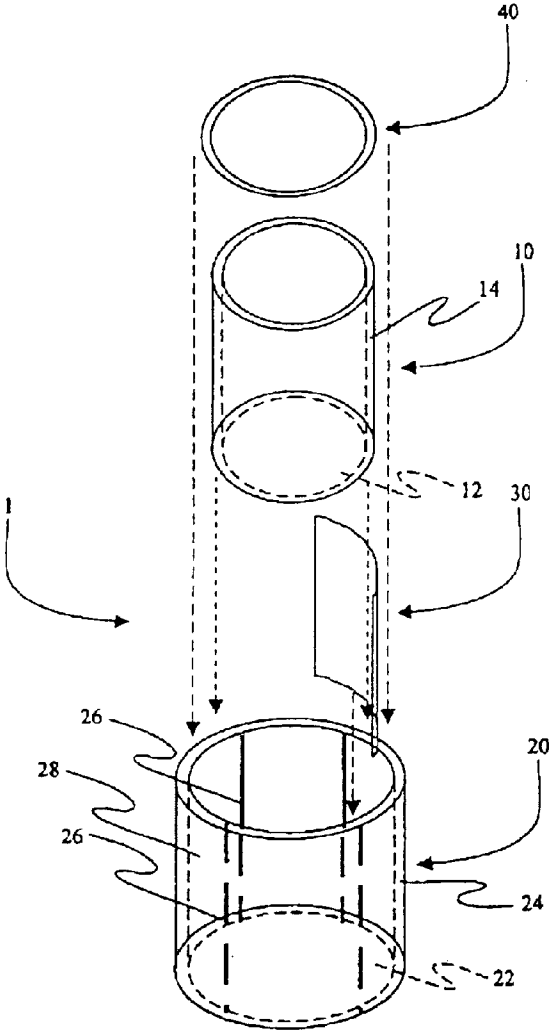
FIG. 2 is an exploded, environmental perspective view of the inventive receptacle.
Figure 1:
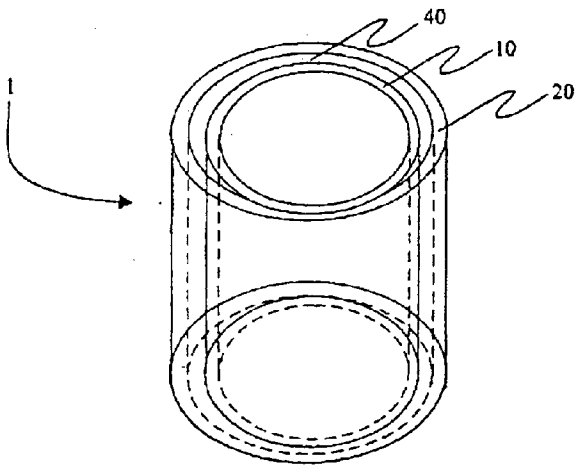
FIG. 1 is an environmental perspective view of the inventive receptacle.

The receptacle 1 of the present invention is depicted generally at FIGS. 1 and 2. The primary elements of receptacle 1 are inner cylinder 10, outer cylinder 20, graphic sheet 30, and gasket 40.

Inner cylinder 10 consists of a bottom panel 12 and a peripheral wall 14. Bottom panel 12 and peripheral wall 14 are formed, preferably of a polymeric material, by any commonly known method, such as, but not limited to, extrusion, injection molding, or vacuum forming. Bottom panel 12 and peripheral wall 14 may be formed as a single unit or as separate elements and joined by a method such as, but not limited to, chemical welding. Bottom panel 12 and peripheral wall 14 may, optionally, be of an opaque, translucent, or transparent material, therefore it would be evident to one skilled in the art that inner cylinder 10 could be formed of other materials, such as, but not limited to, a metal, without departing from the spirit of the invention.

Outer cylinder 20 consists of a bottom panel 22, a peripheral wall 24, and a plurality of vertical spacers 26 formed on the interior surface of peripheral wall 24 and equally spaced thereabout. Like bottom panel 12 and peripheral wall 14, bottom panel 22 and peripheral wall 24 are formed, preferably of a polymeric material, by methods such as, but not limited to, extrusion, injection molding or vacuum forming. Bottom panel 22 and peripheral wall 24, too, may be formed as a single unit or as separate elements and joined by a method such as, but not limited to, chemical welding. Since the intent of the present invention is to display graphic or textual matter through outer cylinder 20, peripheral wall would, preferably, be of a transparent material, although an opaque or translucent material could be utilized.

Vertical spacers 26 are uniformly spaced apart from one another around the inner surface of peripheral wall 24. Each vertical spacer 26 has a length extending from bottom panel 22 to a point proximate the upper edge of peripheral wall 24, a nominal, uniform thickness which spaces peripheral walls 14 and 24 apart from one another by a measurement sufficient to receive the thickness of a graphic sheet 30 (graphic sheet 30 will be further discussed hereinbelow), and a nominal, uniform width which separates the space formed between peripheral walls 14 and 24 into separate compartments 28, each compartment 28 is adapted to receive a graphic sheet 30.

Receptacle 1 could be produced in various sizes wherein compartments 28 are adapted to hold 8½"×11", 8½"×14", or 210 mm×297 mm sheets of paper, as well as other standard sheet sizes. While the intent of the present invention is to utilize standard paper sizes for graphic sheets 30, it would be evident to one skilled in the art that other sizes may be utilized or that multiple sizes could be utilized without departing from the spirit of the invention. Vertical spacers 26 are dimensioned to fit snugly against peripheral wall 14, thereby preventing graphic sheets 30 from slipping between vertical spacer 26 and peripheral wall 14.

A removable gasket 40, preferably of a transparent material, occupies the gap between the upper edges of inner cylinder 10 and outer cylinder 20, preventing the ingress of dirt and/or moisture and securing the graphic sheets 30 within the cavities created between peripheral walls 14 and 24 and vertical spacers 26. It would be evident to one skilled in the art that gasket 40 could be translucent or opaque, as well as transparent.

It would be evident to one skilled in the art that vertical spacers 26 could be formed as an integral element of peripheral wall 24 or joined to peripheral wall 24 by a method such as, but not limited to, chemical welding. It would be further evident to one skilled in the art that vertical spacers 26 could be spaced around the outer surface of peripheral wall 14, in lieu of the inner surface of peripheral wall 24, without departing from the spirit of the present invention. It would, likewise, be evident to one skilled in the art that inner cylinder 10 could be formed without a bottom panel 12, with bottom panel 22 serving as the interior bottom of receptacle 1.

While the term "cylinder" has been used in disclosing the shape of inner cylinder 10 and outer cylinder 20, it would be evident to one skilled in the art that inner cylinder 10 and outer cylinder 20 could be of differing shapes, including, but not limited to, elliptical or polygonal, without departing from the spirit of the present invention. Inner cylinder 10 and outer cylinder 20, regardless of the shape used, may also be frustal (having tapering sides). However, if a frustal shape is utilized, vertical spacers 26 would have a slight wedge shape in order to maintain a uniform measurement therebetween from the bottom to the top of receptacle 1.

Graphic sheets 30 consist of a material such as, but not limited to, paper, cloth or a thin polymeric sheet bearing either a pictorial or textual graphic, or both. As has been stated hereinabove, the intent of the present invention is to be able to utilize standard, stock paper sizes for graphic sheets 30. The graphic may be applied to graphic sheet 30 by any means known in the art, including, but not limited to, printing, stitching, and the like.

Figure 4:
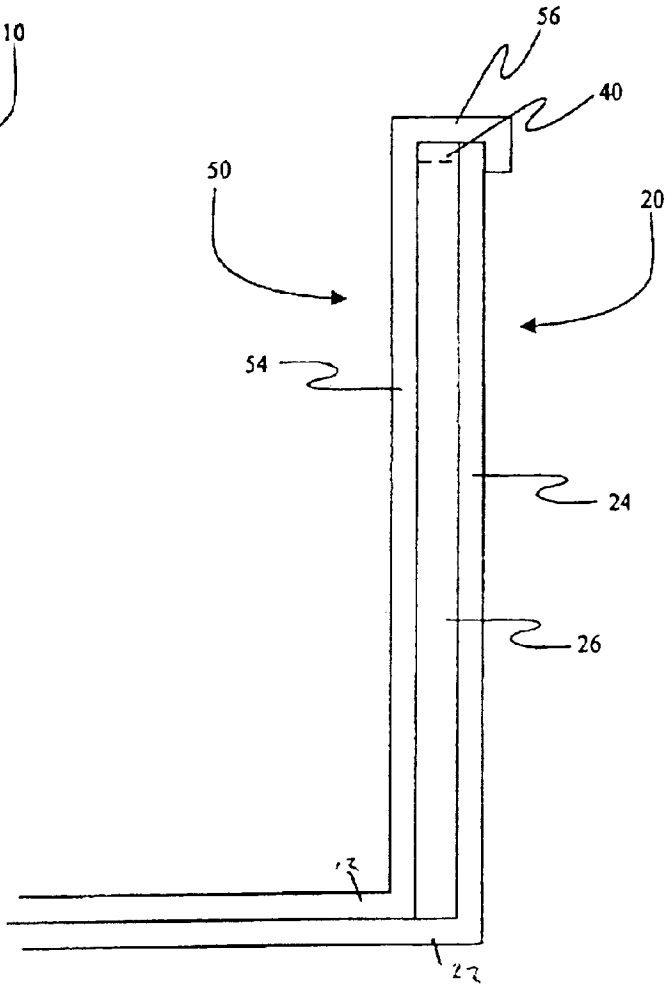
FIG. 4 is a cross sectional view of a second embodiment of the inventive receptacle.
Figure 3:
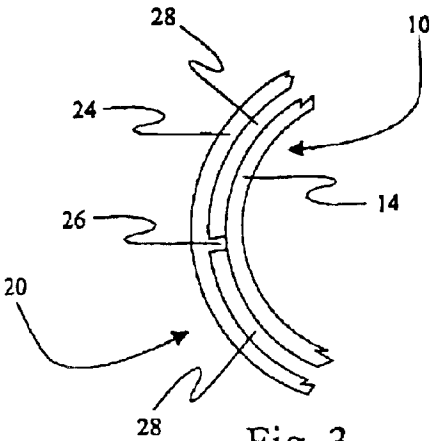
FIG. 3 is a detailed plan view of one of the vertical spacers of the present invention.

In a second embodiment, inner cylinder 50 (shown in cross section at FIG. 4) further includes a lip 56 extending outwardly around the upper edge of peripheral wall 54. Lip 56 forms an inverted "U" extending outwardly and downwardly over the upper edge of peripheral wall 24. A seal may be formed between inner cylinder 50 and outer cylinder 20 by a system wherein the snug relationship between peripheral wall 14 and vertical spacers 26 constrains the upper edge of peripheral wall 24 in close juxtaposition with lip 56. Optionally, a gasket 40 may seal the gap between peripheral wall 14 and peripheral wall 24 or the gap between peripheral wall 24 and lip 56. Vertical spacers 26 are formed on the inner surface of outer cylinder 20 or the outer surface of inner cylinder 10, as in the preferred embodiment described hereinabove, although it would, again, be evident to one skilled in the art that vertical spacers 26 could be formed on the outer surface of inner cylinder 50.

Figure 5:
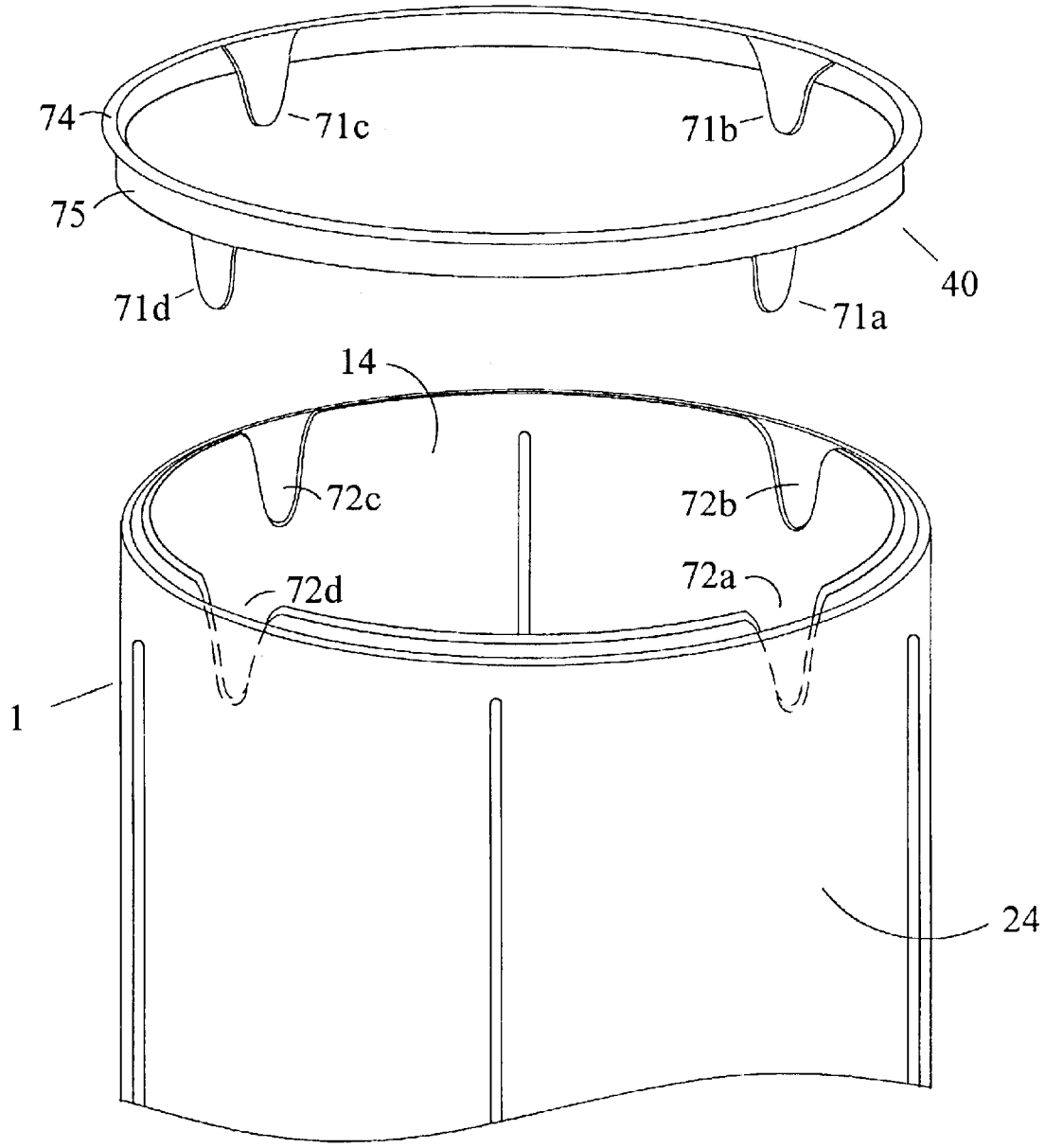
FIG. 5 is a perspective view of a third embodiment, wherein graphic sheet access means are provided on the inner peripheral wall, and the sealing gasket has corresponding downwardly-projecting fingers to seal the graphic sheet access means against moisture or dirt intrusion.

A third embodiment in shown in FIG. 5, wherein graphic sheet access means comprising finger-shaped openings 72*a, b, c*, & *d* are located on the upper vertical surface of inner peripheral wall 14. In this embodiment, sealing gasket 40 is generally ring-shaped as in the prior three embodiments. Sealing gasket 40 has a lip 74 that covers the gap between the top of inner peripheral wall 14 and outer peripheral wall 24. Sealing gasket 40 also has a circular ridge 75 below lip 74 that fits down into the gap between inner peripheral wall 14 and outer peripheral wall 24. Lip 74 has downwardly-projecting fingers 71*a, b, c*, & *d* which seal the corresponding openings 72*a, b, c*, & *d* against moisture or dirt intrusion.

Figure 6:
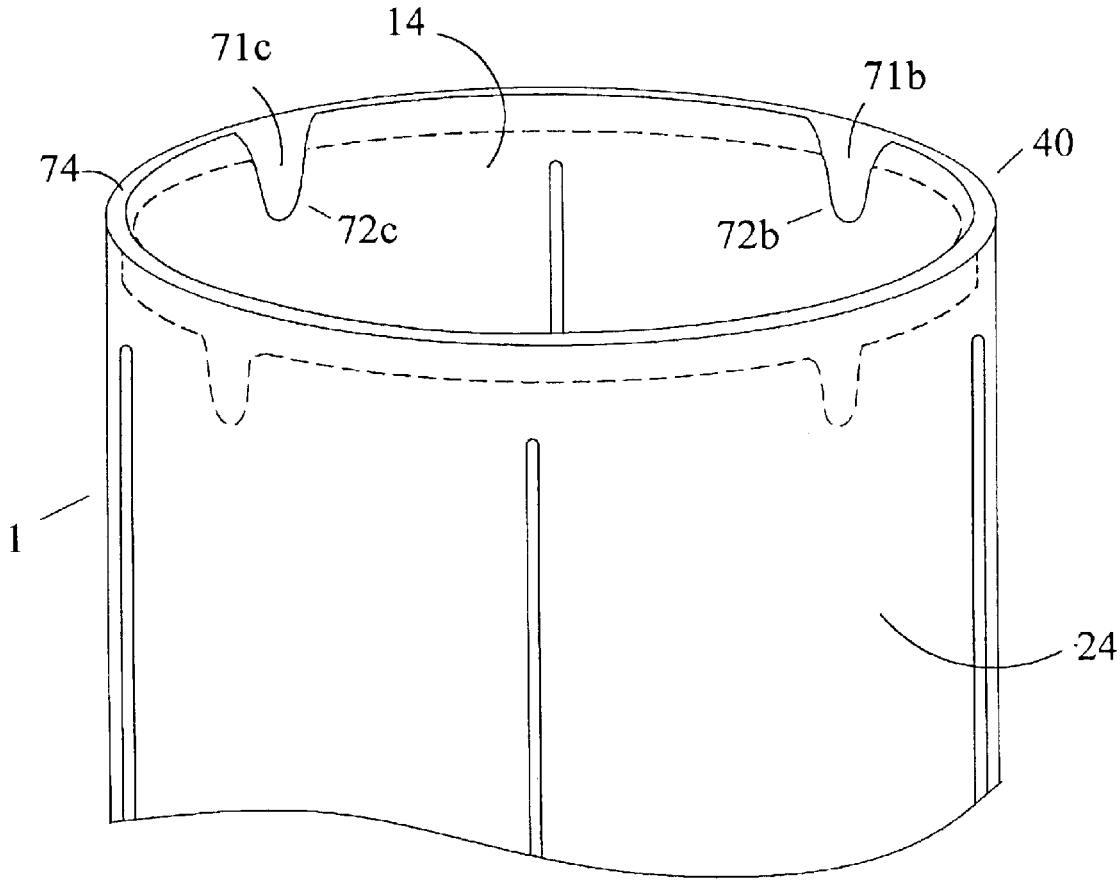
FIG. 6 is an additional perspective view of the third embodiment, illustrating the sealing gasket fitted into place over the top of the receptacle.

It can be appreciated that when gasket 40 is removed from the top of receptacle 1, a user can place his finger on a graphic sheet that has been placed within a compartment and pull up on the graphic sheet, thereby conveniently removing the graphic sheet from receptacle 1 without having to use a tool or turn receptacle 1 upside-down. As shown in FIG. 6, when gasket 40 is placed over the top of receptacle 1 and fitted down into the space between inner peripheral wall 14 and outer peripheral wall 24, fingers 71*a, b, c*, & *d* act to seal openings 72*a, b, c*, & *d* against moisture or dirt intrusion.

Figure 7:
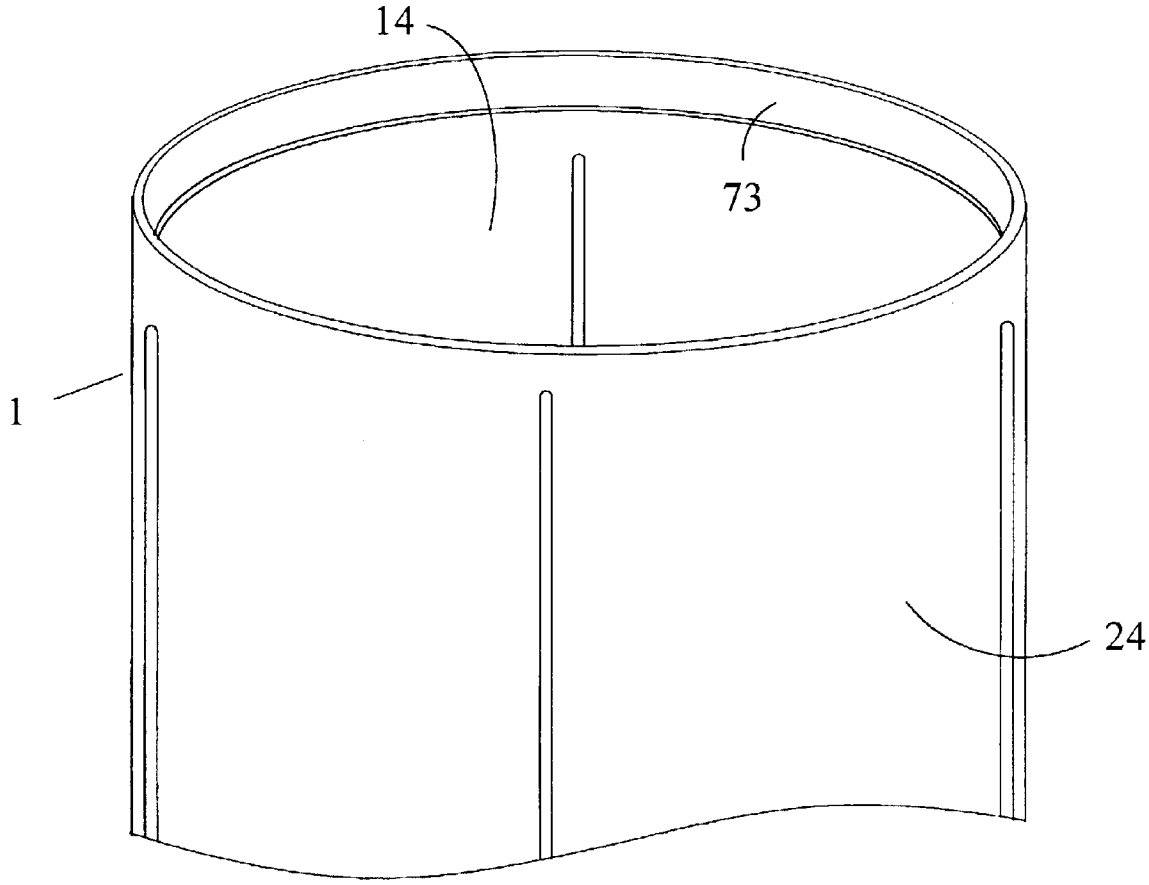
FIG. 7 is a perspective view of a fourth embodiment, wherein a horizontal graphic sheet access slot is provided around the top of the entire inner peripheral wall.

FIG. 7 illustrates a fourth embodiment, wherein inner peripheral wall 14 is somewhat shorter than outer peripheral wall 24, thereby creating a horizontal graphic sheet access slot 73 disposed around the top of the entire inner peripheral wall 14. It should be understood that there is no specific amount by which inner peripheral wall 14 must be shorter than outer peripheral wall 24; rather, the difference in the wall heights need only be enough to expose a sufficient portion of the graphic sheet, so that the graphic sheet can be conveniently removed from receptacle 1 without having to use a tool or turn receptacle 1 upside-down.

It can also be appreciated that in order to seal horizontal access slot 73 when receptacle 1 is in use, gasket 40 must be differently-shaped than as shown in FIGS. 5 and 6. Rather than having spaced fingers 71*a, b, c*, & *d*, gasket 40 would instead have a downwardly-projecting ridge without fingers, disposed around the entire bottom circumference of gasket 40. This downwardly-projecting ridge would fill the gap between the different heights of peripheral walls 14 and 24, and thus seal horizontal access slot 73 against dirt or moisture intrusion.

Figure 8:
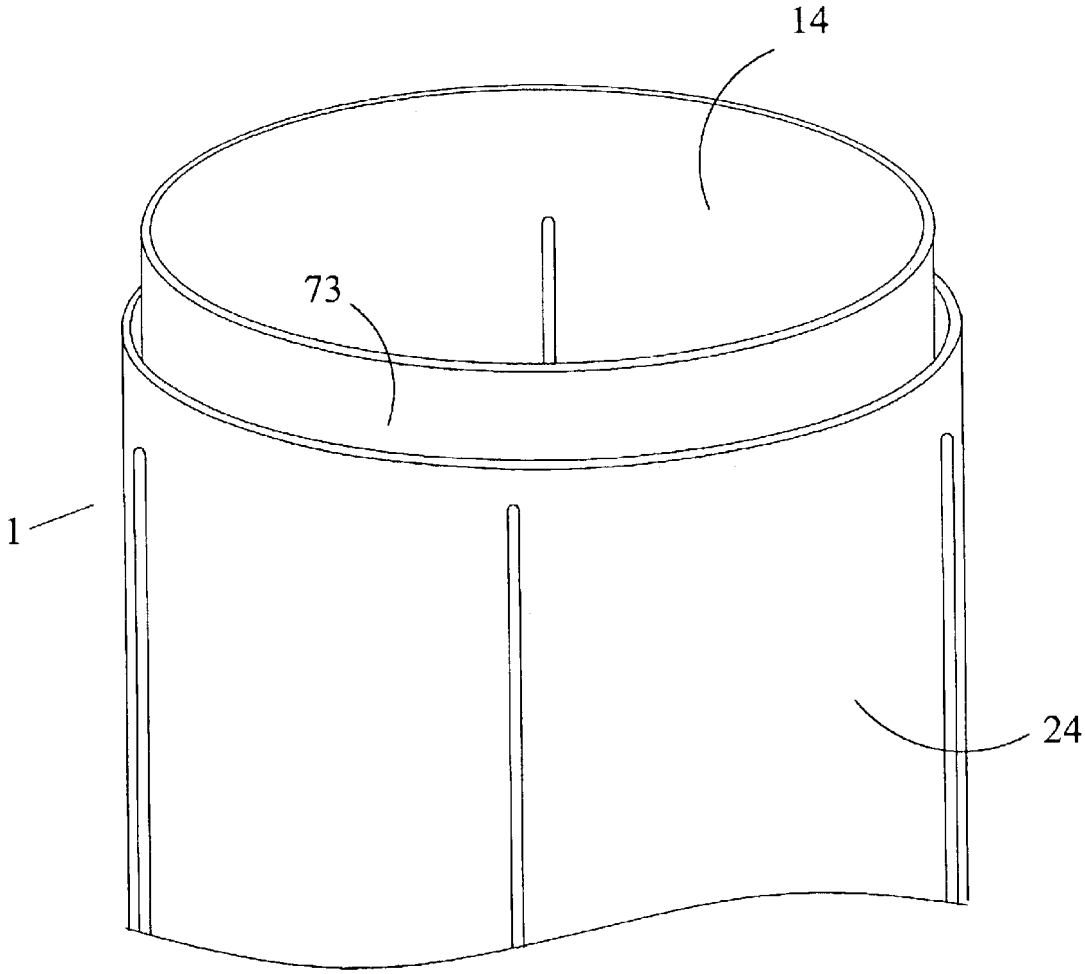
FIG. 8 is a perspective view of a fifth embodiment, similar to the embodiment of FIG. 7 except that the horizontal graphic sheet access slot is provided around the top of the entire outer peripheral wall, rather than the inner peripheral wall as in FIG. 7.

FIG. 8 illustrates yet another embodiment, similar to the embodiment of FIG. 7 except that horizontal graphic sheet access slot 73 is disposed around the top of the entire outer peripheral wall 24, rather than the inner peripheral wall 14 as in FIG. 7. It can be understood that a sealing gasket 40 for use with this embodiment would have a downwardly-projecting ridge without fingers, with the ridge suitably sized and positioned to seal the gap between the somewhat lower outer peripheral wall 24 and the somewhat higher inner peripheral wall 14. Said another way, the diameter of the ridge on the sealing gasket used with the FIG. 8 embodiment will be larger than the diameter of the ridge on the sealing gasket used with the FIG. 7 embodiment, assuming of course that the diameters of the inner and outer peripheral walls are identical between these two embodiments.

The overarching concept of the improvement illustrated herein in FIGS. 5 to 8 is to provide improved graphic sheet access, via means incorporated into the inner or outer peripheral wall, or incorporated into both walls, that allow the user to conveniently change graphic sheets without having to use a tool or turn the receptacle upside down.

As such, there are many possible variations on this overarching concept, beyond those illustrated in the various embodiments. For example, the graphic sheet access means can be located on either the inner peripheral wall or the outer peripheral wall, or on both walls. The length and shape of the graphic sheet access means can be different than that shown in the embodiments; the slots can be deeper, wider, or of a different shape. The downwardly-projecting fingers on the sealing gasket, of course, would be correspondingly shaped to cover the differently-shaped slots while the receptacle is in use.

The number of graphic sheet access points can be different than the four fingers shown in the embodiment of FIGS. 5 and 6, and the placement of the graphic sheet access means can be different than that shown in the various embodiments. As shown in FIGS. 7 and 8, the top of the inner peripheral wall can be somewhat lower than the top of the outer peripheral wall, or vice versa, such that a graphic sheet access means comprised of a horizontal slot disposed around the entire inner or outer peripheral wall is created. Alternatively, the horizontal slot illustrated in FIGS. 7 and 8 can be interrupted at various points, rather than being disposed around the entire inner or outer peripheral wall.

Further, the sealing gasket can exhibit a different structure than that shown and described in the various embodiments, as long as it suitably performs the function of sealing the space between the inner and outer peripheral walls, as well as any opening, slot, or gap represented by the graphic sheet access means, from dirt or moisture intrusion. As just one example, the gasket can be constructed without a ridge, i.e., the gasket can have a lip and fingers or other downward-extending shapes attached to the lip, without a ridge. As another example, the fingers can extend downward from the ridge and not the lip. The sealing gasket can also be eliminated to save material and assembly costs, particularly if the receptacle will not be used in a dirty or moist environment.

As shown and described above, the invention has an inner cylinder closed at the bottom and open at the top, fitted within an outer cylinder also closed at the bottom and open at the top. However, it should be understood that other embodiments are also possible, wherein only one of the two cylinders (either the inner or outer) has a bottom. For example, an embodiment is possible wherein an inner cylinder open at the bottom and top is fitted within an outer cylinder closed at the bottom and open at the top. An embodiment is also possible wherein an inner cylinder closed at the bottom and open at the top is fitted within an outer cylinder open at the bottom and top. In this latter embodiment, a ledge, lip, shelf, or the like is attached to the bottom area of either cylinder, filling the bottom space between the two cylinders and providing a place on which the sheets of graphic material can rest.

Finally, it should be understood that "graphic material", as referred to herein, means material with a design, image, or text; or not—i.e., the sheets of graphic material can have a design, image, or text; can simply be an attractive color without a design, image, or text; or can simply be blank. In other words, the inventive concept of the invention does not depend on the specific nature of the graphic material.

Therefore, it is to be understood that the present invention is not limited to the embodiments described above, but encompasses any and all embodiments within the scope of the following claims.

What is claimed is:

1. A receptacle with peripheral walls for display of graphic material, comprising:

a) an inner peripheral wall, b) an outer peripheral wall, c) separation means for spacing said inner peripheral wall and said outer peripheral wall apart from one another, d) at least one graphic material access opening located on a vertical surface of said inner peripheral wall or said outer peripheral wall, e) a plurality of graphic material sheets, said sheets separated from each other by said separation means, and f) a sealing gasket for sealing said space formed between a top of said inner peripheral wall and a top of said outer peripheral wall and said at least one graphic material access opening, whereby said graphic material can be conveniently changed without using a tool or turning said receptacle upside down.

2. The receptacle of claim 1, wherein said inner peripheral wall has a cylindrical form, said outer peripheral wall has a cylindrical form, and said receptacle also comprises a bottom panel attached to the lower portion of said outer peripheral wall.

3. The receptacle of claim 1, wherein said graphic material access opening is finger-shaped and extends downward from a top edge of said inner peripheral wall.

4. The receptacle of claim 3, wherein four spaced finger-shaped graphic material access openings extend downward from a top edge of said inner peripheral wall.

5. The receptacle of claim 1, wherein said separation means comprises a plurality of vertical spacers disposed between said inner peripheral wall and said outer peripheral wall.

6. The receptacle of claim 1, wherein said sealing gasket is adapted for removable placement over a top edge of said inner peripheral wall or a top edge of said outer peripheral wall.

7. The receptacle of claim 8, wherein said gasket is a ring with a circular main body and at least one finger projecting downward from said main body, said finger fitting into said graphic material access opening having a finger shape.

8. The receptacle of claim 9, wherein said gasket is a ring with a circular main body and four fingers projecting downward from said main body.

* * * * *